US009650180B2

(12) United States Patent
Cigallio et al.

(10) Patent No.: US 9,650,180 B2
(45) Date of Patent: May 16, 2017

(54) TAMPER-INDICATING SHAPES FOR FLEXIBLE RECLOSEABLE PACKAGES

(71) Applicant: Printpack Illinois, Inc., Elgin, IL (US)

(72) Inventors: Ed Cigallio, Douglasville, GA (US); Don Mallik, Atlanta, GA (US); Robert Cagle, Douglasville, GA (US); Brent Holloway, Douglasville, GA (US); Ronald W. Komro, Smyrna, GA (US); Joseph O'Connell, Palmyra, PA (US); Michael Payne, Himmelstown, PA (US); Melinda Stamm, Palmyra, PA (US); William R. Pierce, Hummelstown, PA (US)

(73) Assignee: Printpack Illinois, Inc., Elgin, IL (US)

( * ) Notice: Subject to any disclaimer, the term of this patent is extended or adjusted under 35 U.S.C. 154(b) by 0 days.

(21) Appl. No.: 14/523,332

(22) Filed: Oct. 24, 2014

(65) Prior Publication Data

US 2015/0117797 A1 Apr. 30, 2015

Related U.S. Application Data

(60) Provisional application No. 62/016,608, filed on Jun. 24, 2014, provisional application No. 61/895,804, filed on Oct. 25, 2013.

(51) Int. Cl.
*B65D 33/34* (2006.01)

(52) U.S. Cl.
CPC ..... *B65D 33/34* (2013.01); *B65D 2101/0015* (2013.01)

(58) Field of Classification Search
CPC ..... B65D 75/5838; B65D 2101/00; B65D 2575/586; B65D 75/5855; B65D 33/34; B65D 2101/0015; Y10T 428/14
USPC ..... 383/5, 210–211, 200, 203–204, 207–209
See application file for complete search history.

(56) References Cited

U.S. PATENT DOCUMENTS

| | | | | |
|---|---|---|---|---|
| 2,128,196 | A * | 8/1938 | Vogel | 229/81 |
| 4,552,269 | A * | 11/1985 | Chang | 383/211 |
| 5,727,819 | A | 3/1998 | Grosskopf et al. | |
| 6,026,953 | A * | 2/2000 | Nakamura et al. | 206/233 |
| 6,349,828 | B1 | 2/2002 | Sessions et al. | |
| 6,428,867 | B1 | 8/2002 | Scott et al. | |
| 6,589,622 | B1 | 7/2003 | Scott | |
| 6,616,334 | B2 * | 9/2003 | Faaborg et al. | 383/211 |
| 7,344,744 | B2 * | 3/2008 | Sierra-Gomez et al. | 426/119 |
| 7,744,517 | B2 * | 6/2010 | Bonenfant | 493/223 |
| 7,963,413 | B2 * | 6/2011 | Sierra-Gomez et al. | 220/256.1 |
| 8,308,363 | B2 * | 11/2012 | Vogt et al. | 383/5 |

(Continued)

FOREIGN PATENT DOCUMENTS

| | | |
|---|---|---|
| WO | 2010/046623 A2 | 4/2010 |
| WO | 2010046623 | 4/2010 |

(Continued)

*Primary Examiner* — Peter Helvey
(74) *Attorney, Agent, or Firm* — Eversheds Sutherland (US) LLP

(57) ABSTRACT

A recloseable package is provided having a tamper-indicating element. The tamper-indicating element include one or more self-terminating shapes that form one or more chads after opening the recloseable package. Advantageously, the self-terminating shapes provide a simple, visual cue of graphical alignment in the seal to show the customer whether or not a package has been opened.

20 Claims, 6 Drawing Sheets

(56) References Cited

U.S. PATENT DOCUMENTS

| | | | | |
|---|---|---|---|---|
| 8,408,792 | B2 * | 4/2013 | Cole et al. | 383/203 |
| 8,545,099 | B2 * | 10/2013 | Davis et al. | 383/5 |
| 8,746,483 | B2 * | 6/2014 | Sierra-Gomez et al. | 220/256.1 |
| 2004/0206637 | A1 | 10/2004 | Sierra-Gomez et al. | |
| 2005/0247764 | A1 * | 11/2005 | Sierra-Gomez et al. | 229/87.08 |
| 2005/0276525 | A1 | 12/2005 | Hebert et al. | |
| 2006/0018569 | A1 | 1/2006 | Bonenfant | |
| 2007/0095709 | A1 * | 5/2007 | Saito et al. | 206/494 |
| 2007/0275133 | A1 * | 11/2007 | Sierra-Gomez et al. | 426/122 |
| 2008/0037911 | A1 | 2/2008 | Cole et al. | |
| 2008/0156861 | A1 | 7/2008 | Sierra-Gomez et al. | |
| 2008/0233424 | A1 | 9/2008 | Thorstensen-Woll et al. | |
| 2008/0240627 | A1 * | 10/2008 | Cole et al. | 383/204 |
| 2009/0178945 | A1 | 7/2009 | Moehlenbrock et al. | |
| 2009/0226117 | A1 * | 9/2009 | Davis et al. | 383/5 |
| 2010/0002963 | A1 | 1/2010 | Holbert et al. | |
| 2010/0018974 | A1 | 1/2010 | Lyzenga et al. | |
| 2010/0019022 | A1 * | 1/2010 | Ryan et al. | 229/122 |
| 2010/0278454 | A1 * | 11/2010 | Huffer | 383/5 |
| 2011/0094193 | A1 | 4/2011 | Daelmans et al. | |
| 2011/0268371 | A1 | 11/2011 | Kristal | |
| 2012/0177307 | A1 | 7/2012 | Duan et al. | |

FOREIGN PATENT DOCUMENTS

| | | | |
|---|---|---|---|
| WO | 2012032327 | A1 | 3/2012 |
| WO | 2012/098412 | A1 | 7/2012 |
| WO | 2012098412 | | 7/2012 |

* cited by examiner

TAMPER-INDICATING SHAPES FOR FLEXIBLE RECLOSEABLE PACKAGES

CROSS REFERENCES TO RELATED APPLICATIONS

This application claims priority to U.S. Provisional Patent Application No. 61/895,804, filed Oct. 25, 2013, and U.S. Provisional Patent Application No. 62/016,608, filed Jun. 24, 2014, the disclosures of which are incorporated herein by reference.

BACKGROUND

The present application relates generally to flexible packages for containing various products. More particularly, the present application relates to a flexible package for containing food products, particularly confectionary products, which is a recloseable structure with a self-terminating shape providing tamper evidence.

A variety of different types of flexible packaging are known in the art for containing and dispensing products, particularly food products. Often, consumers may desire to use only a portion of the product contained in the package, resulting in a problem with storing the remaining product in the package. This problem is particularly evident in packages having two sealed ends which initially contain and protect the product.

Thus, there exists a need to provide a simple, cost effective and useful solution for providing tamper-evidence in recloseable packages.

SUMMARY OF THE DESCRIPTION

Embodiments of the present description address the above-described needs by providing opening systems for recloseable packages and recloseable packages prepared therefrom. The opening systems may be included in various package features, including in end seals, fin seals, or opening panel sections.

In one aspect, an opening system for a recloseable package includes a flexible film having an openable panel section for providing an access opening through the flexible film, the openable panel section being defined by a line of weakness forming a defined opening in the flexible film. A flexible reclose feature may be disposed on and covering the defined opening of the openable panel section, the flexible reclose feature including a resealable adhesive layer extending beyond the defined opening for releasably adhering the flexible reclose feature to the flexible film about the defined opening. A tamper-indicating element of one or more self-terminating shapes may be formed in the flexible reclose feature or the flexible film such that initial opening of the openable panel section results in one or more chads being formed from the one or more self-terminating shapes, the one or more chads of the tamper-indicating element being transferred from the flexible reclose feature to the flexible film or from the flexible film to the flexible reclose feature.

In another aspect, a recloseable package is provided including a flexible film having at least a pair of opposing edge portions forming a seal. A tamper-indicating element is disposed in a seal of the package, the tamper-indicating element including one or more self-terminating shapes formed in the flexible film in at least one of the first pair of opposing edge portions. The seal may be one or more end seals and/or a longitudinal fin seal. The tamper-indicating element forms a chad from the self-terminating shape after opening the seal, the chad being transferred from one of the pair of opposing edge portions in which the self-terminating shape is made to another of the pair of opposing edge portions.

In another aspect, a laminate is provided for producing recloseable flexible packages comprising a continuous web of flexible film having a width with two opposing longitudinal edge portions. The flexible film includes a series of self-terminating shapes extending along at least one of the two opposing longitudinal edge portions of the flexible film and an adhesive layer applied to the continuous web of flexible film in an asymmetrical rectangular pattern. The asymmetrical pattern extends along two opposing lateral edge portions and the two opposing longitudinal edge portions. The series of self-terminating shapes remain substantially free of the adhesive layer, such that the adhesive layer is applied laterally interior and longitudinally parallel to the longitudinal edge portion in which the series of self-terminating shapes are formed.

In still another aspect, a method is provided for forming a recloseable package. The method comprises providing a flexible film for forming a recloseable package, the flexible film having a width defined by two opposing longitudinal edges and forming a series of self-terminating shapes in the flexible film along one or both of the longitudinal edges. A cold seal adhesive is applied in an asymmetrical rectangular pattern along the two longitudinal edges of the flexible film in a pattern in which the area with the self-terminating shapes is substantially free of the cold seal adhesive and the cold seal adhesive is positioned laterally interior and longitudinally parallel to the series of self-terminating shapes. The method further includes forming a longitudinal fin seal by joining the two opposing longitudinal edge portions of the flexible film; forming a first end seal; and forming a second end seal opposite the first end seal.

DETAILED DESCRIPTION

Embodiments of the present description address the above-described needs by providing opening systems for use in recloseable flexible packages and recloseable flexible packages having tamper-indicating elements, and films and methods for producing such packages.

In one aspect, embodiments of opening systems and recloseable packages comprising opening systems have an openable panel section for providing an access opening through a flexible film including a tamper-indicating element. In another aspect, embodiments of recloseable packages comprise a tamper-indicating element disposed in one or more seals formed between opposing edge portions of flexible film. The tamper-indicating elements may comprise one or more self-terminating shapes formed.

"Self-terminating shape", as used herein, refers to a shape with a geometry with controlled tear initiation points that, when torn, propagates the tear inside the perimeter of the shape and prevents the unintentional and undesirable tearing of the flexible film outside the perimeter of the shape and creates one or more chads. The geometry may be an open geometry or a closed geometry, depending in part on the type of of opening system and flexible film being used. An "open geometry" is one in which the perimeter of the shape does not start and end at the same point (i.e., is a partially formed shape), while a "closed geometry" is one in which the perimeter of the shape starts and ends at the same point (i.e., a complete formed shape). In embodiments, the geometry is symmetrical or asymmetrical, depending in part on whether the package can be opened in one or two directions, as described in more detail hereinbelow. For example, the symmetrical, open geometry may be an open curvilinear shape, a non-limiting example of which is the open bean shape illustrated in FIG. 1, which illustrates a tamper-indicating element having a bean shape with an opening along at least a portion of its concave side. In some embodiments, the self-terminating shapes are an asymmetrical, open geometry; a symmetrical, closed geometry; an asymmetrical closed geometry; or combinations thereof. The self-terminating shape can be made using any suitable apparatus and method for cutting a shape in a flexible film with a high degree of precision and without removing the chad defined by the perimeter of the shape from the flexible film, including but not limited to by a mechanical punch, laser, or other suitable means.

Figure 1:
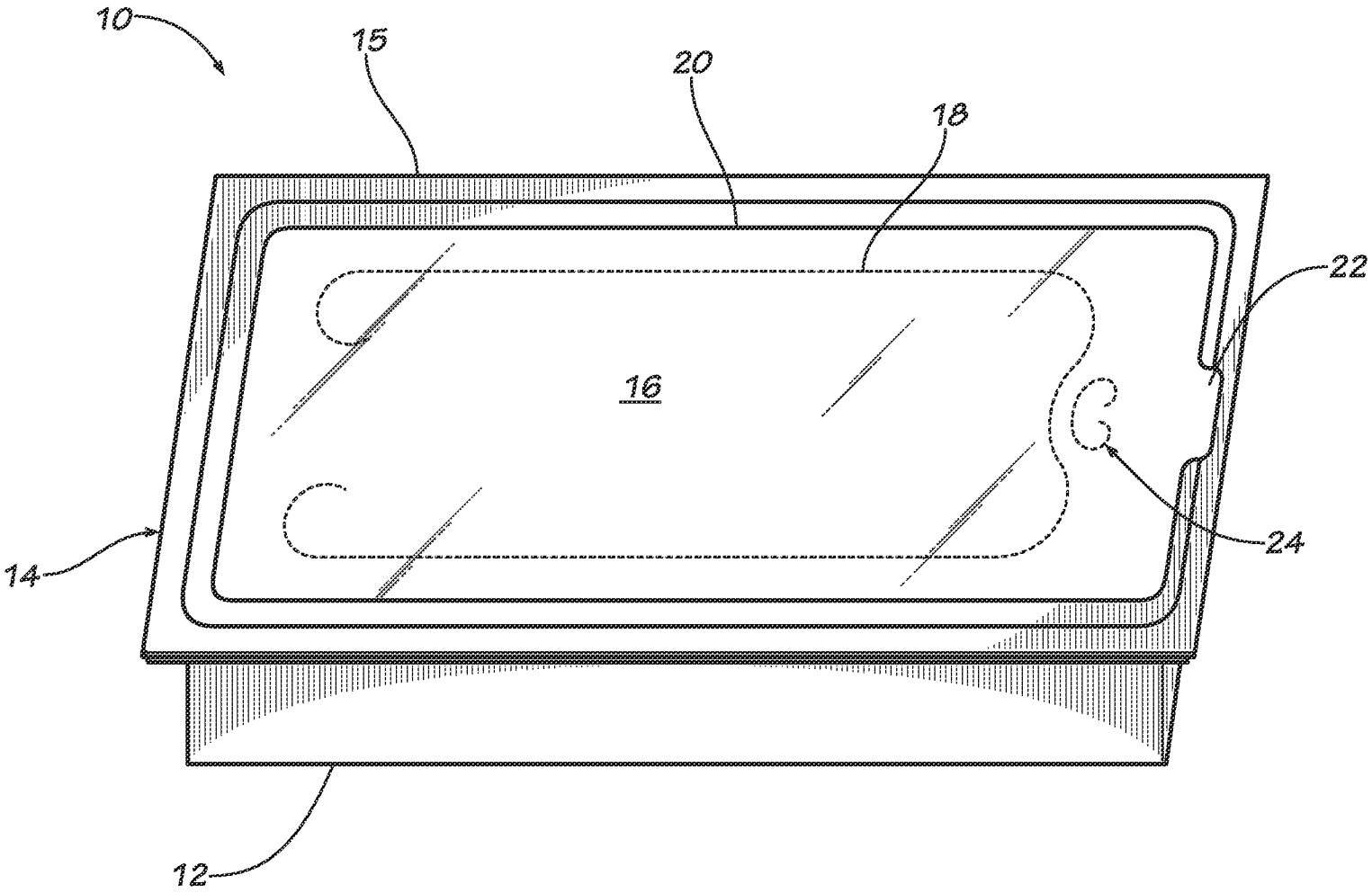
FIG. 1 is a partial perspective drawing of a recloseable package according to an embodiment.
Figure 2:
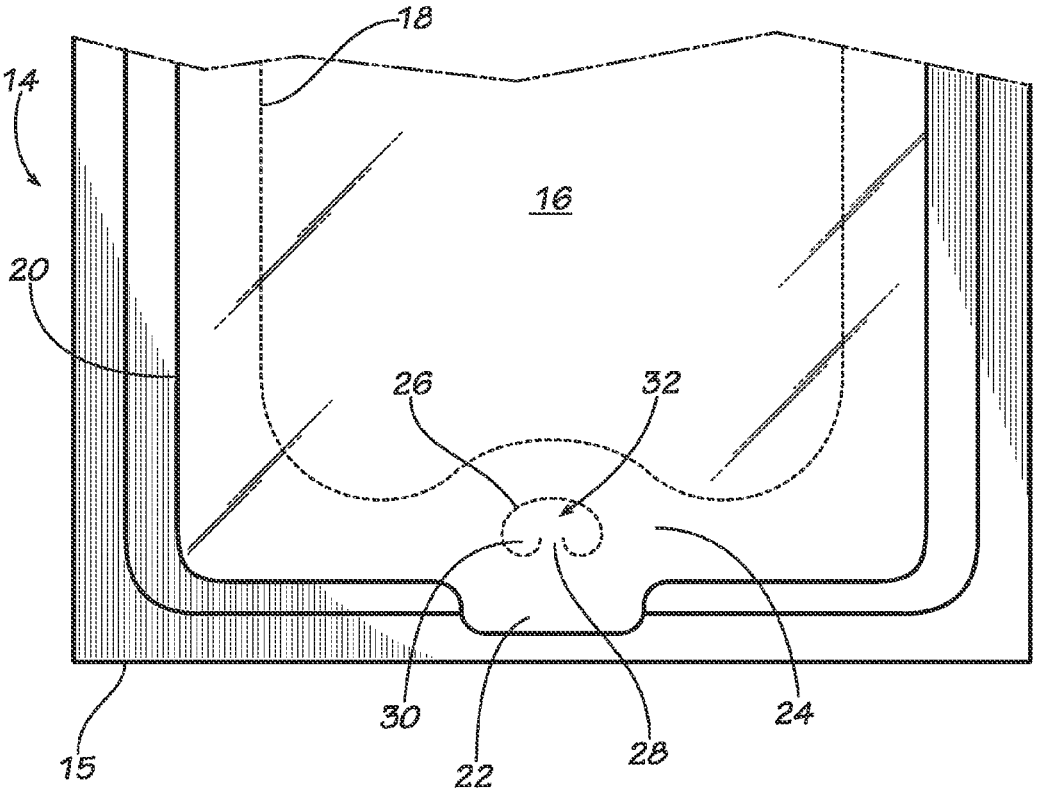
FIG. 2 is a partial top view of the opening system of the recloseable package of FIG. 1.
Figure 3A:
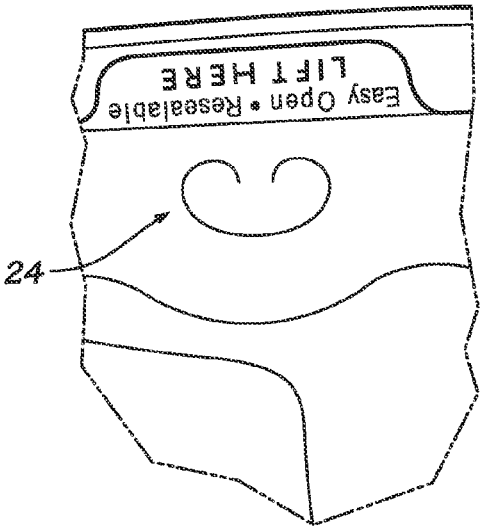
FIG. 3A-3D are schematic illustrations of opening the recloseable package of FIG. 1.
Figure 3B:
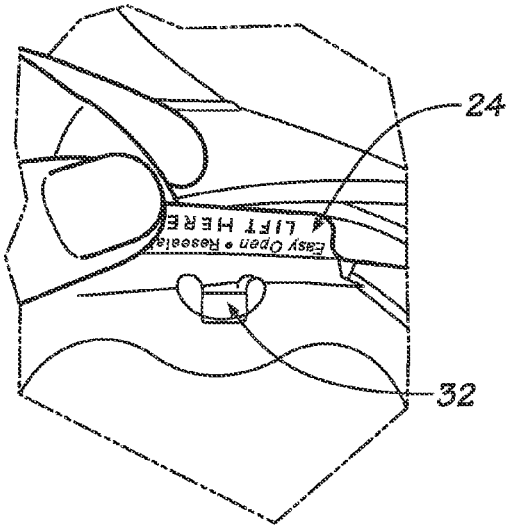
Figure 3C:
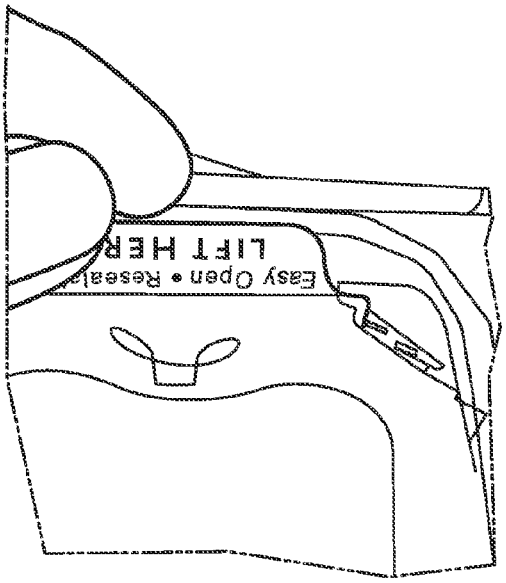
Figure 3D:
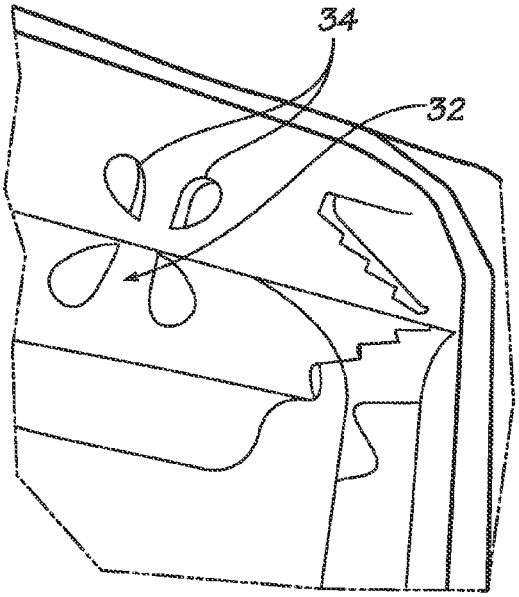
Figure 5:
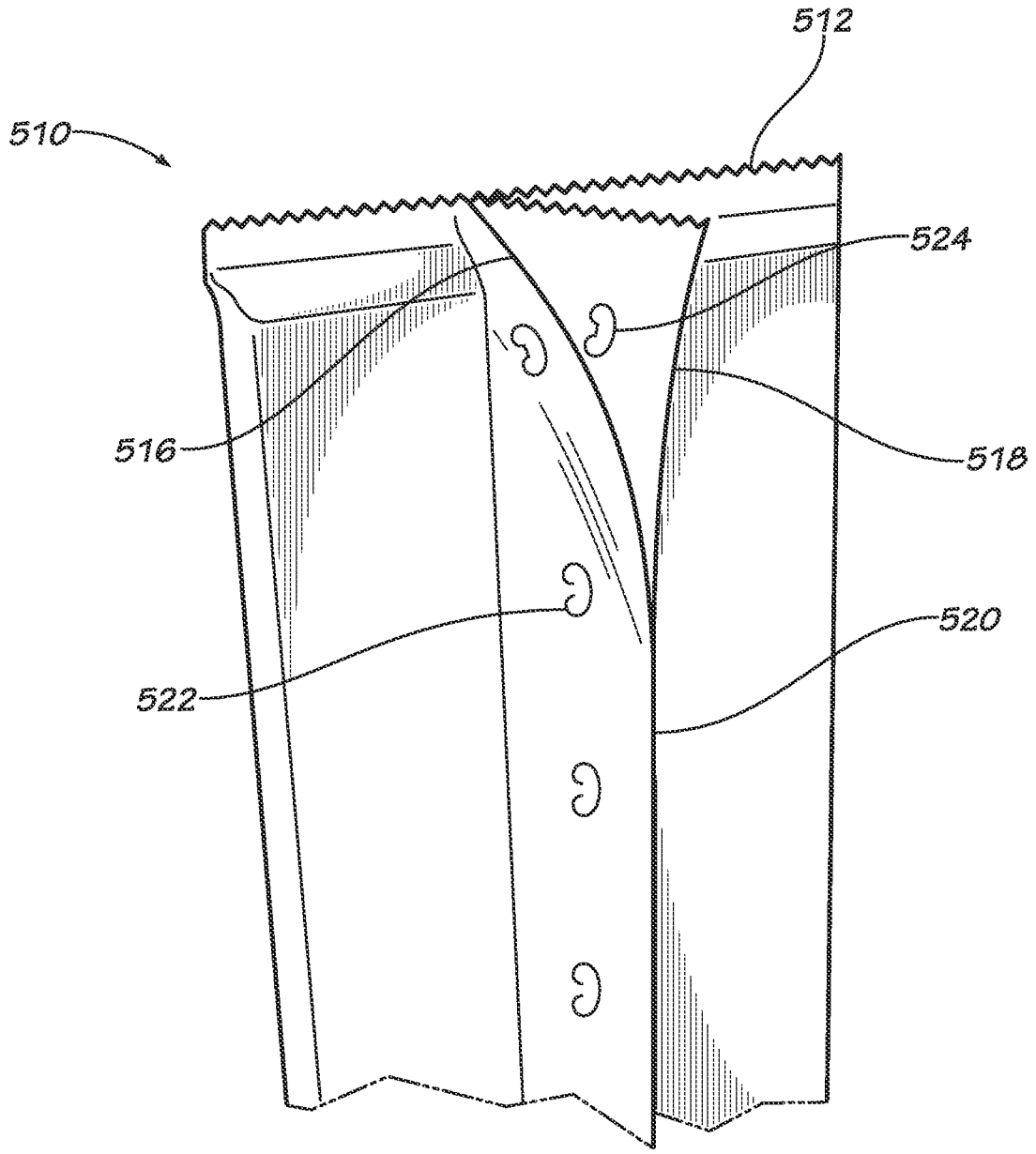
FIG. 5 is a partial perspective drawing of a recloseable flexible package according to an embodiment.

Whether the self-terminating shape forms a single chad or one or more chads depends at least in part on the direction the self-terminating shape is positioned relative to how the package is opened. For example, the self-terminating shape illustrated in FIGS. 1-3 is positioned such that the closed, curvilinear portion of the self-terminating shape creates lift/separation of the reclose feature at the self-terminating shape. The tear may be initiated at one or more tear initiation points in the self-terminating shape (e.g., end points having a J-hook configuration), occur in the direction of the pull, and terminate at the closed curvilinear portion of the self-terminating shape. In another embodiment, the self-terminating shape could be rotated 90 degrees relative to that shown in FIGS. 1-3, in which case the tear may be initiated at the outermost tear initiation point, occur in the direction of the pull, and terminate at the opposing tear initiation point to form a single chad, such as illustrated in FIGS. 5-7.

Recloseable Packages with Openable Panel Systems

In one embodiment, opening systems for recloseable packages comprise an openable panel section for providing an access opening through a flexible film. The openable panel section may be defined in the flexible film by a line of weakness forming a defined opening in the flexible film. A flexible reclose feature may be disposed over and cover the defined opening of the openable panel section. In embodiments, the flexible reclose feature includes a resealable adhesive layer extending beyond the defined opening for releasably adhering the flexible reclose feature to the flexible film about the defined opening. The tamper-indicating element may be disposed in the flexible reclose feature or flexible film such that initial opening of the openable panel section results in one or more chads being formed from the one or more self-terminating shapes, the one or more chads of the tamper indicating element being transferred from the flexible reclose feature to the flexible film or the flexible film to the flexible reclose feature.

An exemplary embodiment of the recloseable package is illustrated in FIGS. 1-3, which illustrate a package 10 having a base portion 12 with an opening system comprising a front panel 14. The front panel 14 includes a flexible film 15 with a reclose feature 20 disposed on and covering a defined opening 18 of an openable panel section 16 in the flexible film 15. The reclose feature 20 includes a resealable adhesive layer extending beyond the defined opening 18 for releasably adhering the reclose feature 20 to the flexible film 15 about the defined opening 18 and a tab 22 for lifting and separating the reclose feature 20 and the associated openable panel section 16 from the flexible film 15 surrounding the defined opening 18 to provide access to any products contained therein.

A self-terminating shape 24 is disposed in the reclose feature 20 and has an open curvilinear bean shape. The self-terminating shape 24 has a closed curvilinear portion 26 and an open curvilinear portion 28 that terminates at two tear initiation points 30 having a J-hook configuration in the self-terminating shape. A kill zone 32 (e.g., an area in which the bond strength of the adhesive is reduced over a portion or all of the area as compared to an area with adhesive) across a portion of the area inside the self-terminating shape 24 may extend beyond the expected tear lines, allowing the tears to be formed beginning at the tear initiation points 30 in the direction the reclose feature is pulled and to terminate at the closed curvilinear portion 26 of the self-terminating shape 24. The tears form two lobe-shaped chads 34 that remain affixed to the flexible film 15 while a portion of the self-terminating shape 24 in the kill zone 32 remains attached to the reclose feature 20. In embodiments, the kill zone 32 may extend slightly beyond the expected location of tear lines to allow for variance in random tear propagation.

Any number of self-terminating shapes may be disposed in the reclose feature depending on the number of tamper indicating elements desired. In addition, the self-terminating shapes may instead be disposed in the flexible film of the opening system rather than the reclose feature, such that the initial opening of the reclose feature causes the transfer of the one or more chads from the flexible film to the reclose feature. In embodiments, the self-terminating shapes may be formed in a combination of the flexible film and/or reclose feature in appropriate configurations. For example, the self-terminating shapes may alternately be formed in the flexible film and reclose feature in a pattern offset from each other.

The front panel 14 may be adhered to the base portion 12 of the recloseable package 10 using methods known to those skilled in the art. For example, the front panel 14 may be adhered to the base portion 12 of the recloseable package 10 using a heat seal, RF, ultrasonics, cold seal, or other appropriate adhesives. For example, in embodiments the front panel 14 may be adhered to the base portion of the recloseable package by heat sealing the front panel 14 along the perimeter of the base portion 12.

Likewise, the reclose feature 20 may be adhered to the flexible film 15 using methods known to those skilled in the art. For example, the front panel 14 may be permanently adhered to the openable panel section 16 using suitable adhesives and may have a pressure sensitive adhesive applied to the reclose feature 20 in a pattern covering all or a portion of the reclose feature 20 extending beyond the defined opening 18, except for a portion of the reclose feature in which the tamper indicating element 24 is formed, which may be substantially free of the pressure sensitive adhesive or which may have a kill zone or modified chemistry (e.g., by using one or more outer coatings to impart the same functionality). For example, a kill zone may be formed by applying the pressure sensitive adhesive and then a deadening agent over the one or more portions of the adhesive for which reduction of bond strength is desired. In another example, the kill zone may be formed by applying an adhesive as a pattern, i.e. a patterned adhesive, over the one or more areas for which reduction of bond strength is desired.

Figure 4:
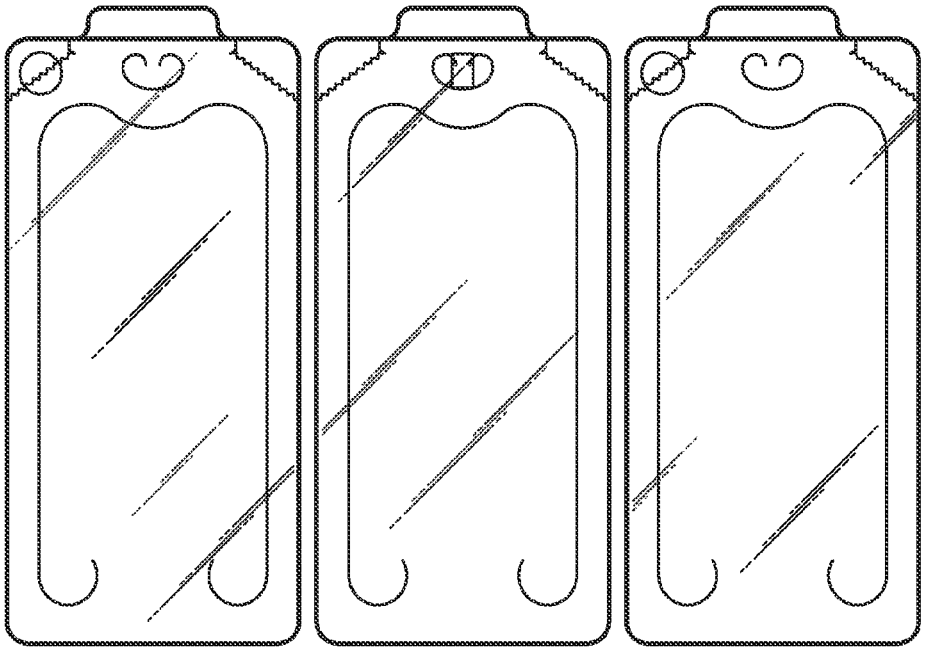
FIG. 4 is a top view of a laminate having a plurality of opening systems for use in the recloseable package of FIG. 1.

The opening systems of the recloseable packages may be prepared from a laminate comprising a continuous web of flexible film onto which a plurality of reclose features are pre-applied (FIG. 4) or applied in-line. The self-terminating shapes may be formed in the reclose features and/or flexible film before the reclose features are positioned over the defined opening. In some embodiments, the laminates are used in the manufacture of flow-wrap packages incorporating opening systems with recloseable reclose features. In other embodiments, the laminates are used to form front panels that may be applied to a separate base portion of the packages using either rolls of the aforementioned laminate or by forming the self-terminating shapes in the reclose features and/or flexible film and applying the reclose features over the defined opening directly in the packaging assembly. The packaging assembly may include one or more products which are packaged in the recloseable packages produced using methods known in the art. For example, in some embodiments the packaging assembly fills a base portion of the recloseable package with product and the laminate is fed from a roll and wrapped around or sealed to the base portion (i.e., as a front panel) to fully enclose the product. The laminate may be cut to separate the plurality of front panels before or after the laminate is sealed to the base portion. In some embodiments, the package is produced, for example, using a flow-wrap packaging machine in which the laminate is fed from a roll, folded about each product in turn, and sealed to fully enclose the product.

In embodiments in which the laminate is formed directly in the packaging assembly, the package may be prepared by first forming the laminate in-line from a continuous web of reclose features and a continuous web of flexible film by forming a series of self-terminating shapes in reclose features and/or the flexible film using a mechanical punch, laser, or other suitable means. The adhesive then may be applied to the continuous web of reclose features and/or flexible film in a desired pattern and the reclose features may be applied to the flexible film to provide the laminate for forming the front panels. The laminate then may be introduced directly into the packaging machine to form the packages as described above.

Recloseable Packages with Recloseable Seals

In another aspect, embodiments of recloseable packages comprise a flexible film having a tamper-indicating element disposed in one or more seals. For example, the package may include at least a pair of opposing edge portions forming a first seal, a tamper-indicating element being disposed in the first seal of the package. The tamper-indicating element may comprise one or more self-terminating shapes formed in the flexible film in at least one of the first pair of opposing edge portions. The tamper-indicating element forms a chad defined by the self-terminating shape after opening the first seal, which results in the transfer of the chad from one of the pair of opposing edge portions in which the self-terminating shape is made to another of the pair of opposing edge portions.

An exemplary embodiment of such a recloseable flexible package is illustrated in FIG. 5, which illustrates a horizontal flow-wrap package 510 having a first pair of opposing lateral edge portions forming a first end seal 512, a second pair of opposing lateral edge portions forming a second end seal (not shown), and a pair of opposing longitudinal edge portions 516, 518 forming a longitudinal fin seal 520 extending from the first end seal 512 to the second end seal. As illustrated in FIG. 5, the longitudinal fin seal 520 may be positioned along one side of the package (usually the back side). Alternatively, the longitudinal fin seal may be positioned along a longitudinal edge of the package (not shown).

A series of self-terminating shapes 522 are disposed in the flexible film of at least one of the opposing longitudinal edge portions 516 of the longitudinal fin seal 520. The self-terminating shape 522 forms one or more chads 524 defined by the self-terminating shape 522 when the longitudinal fin seal 520 is opened from either direction (i.e., bi-directional), which results in the transfer of the one or more chads 524 from the opposing edge portion 516 in which the self-terminating shape 522 is made to the other of opposing edge portion 518. In embodiments, the self-terminating shape may be formed in the flexible film of both opposing edge portions in appropriate configurations. For example, the self-terminating shapes in the opposing edge portions may be offset from each other.

Although symmetrical, open curvilinear shapes are preferred for the self-terminating shapes, other open and closed geometries may be used with seals that open in only one direction (i.e., uni-directional) or with seals formed using non-oriented films. For example, an open angular shape may have the needed functionality for uni-directional seals, non-limiting examples of which include an open triangle, diamond, and the like. In other embodiments, a closed geometry may have the needed functionality for non-oriented webs, non-limiting examples of which include circles, tear drops, and the like.

The first end seal 512 and second end seal (collectively referred to as the transverse end seals) and longitudinal fin seal 520 desirably are formed by bonding the respective opposing edge portions together using a cold seal adhesive. Other methods of forming one or more of the seals also may be used, non-limiting examples of which include heat, RF, ultrasonics, and pressure sensitive adhesives. For example, in embodiments the transverse end seals may be formed by heat sealing the opposing edge portions while the longitudinal fin seal is formed using a cold seal adhesive.

While standard cold seal patterns (not shown) may be appropriate in some embodiments (i.e., a rectangular shape disposed along each of the edge portions), the cold seal adhesive may be applied to the flexible film in a pattern covering only a portion of the opposing edge portion in which the self-terminating shapes are disposed. For example, in embodiments the portion of the flexible film of the edge portion in which the tamper-indicating element is formed is substantially free of a cold seal adhesive. Two embodiments of cold seal patterns are illustrated in FIGS. 6A-6B and 7A-7B, which show an outer surface (FIGS. 6A and 7A) and inner surface (FIGS. 6B and 7B) of a flexible film.

Figure 6B:
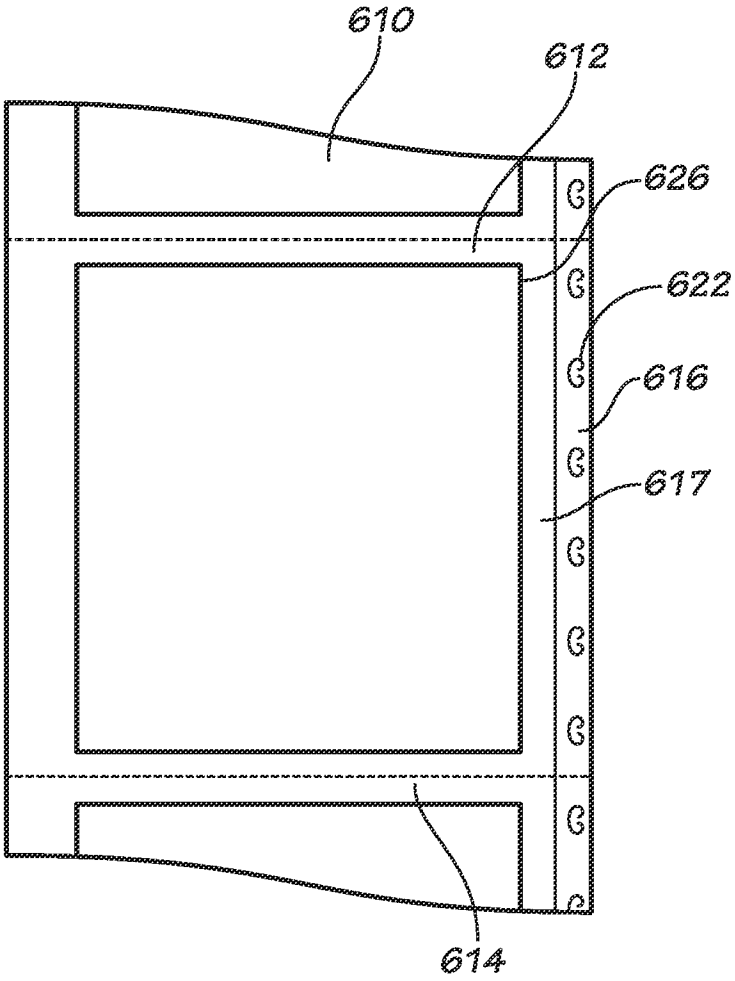
FIGS. 6A-6B and FIG. 7A-7B are planar illustrations of the outer and inner surface of the laminate used to form embodiments of the recloseable flexible packages of FIG. 5.
Figure 6A:
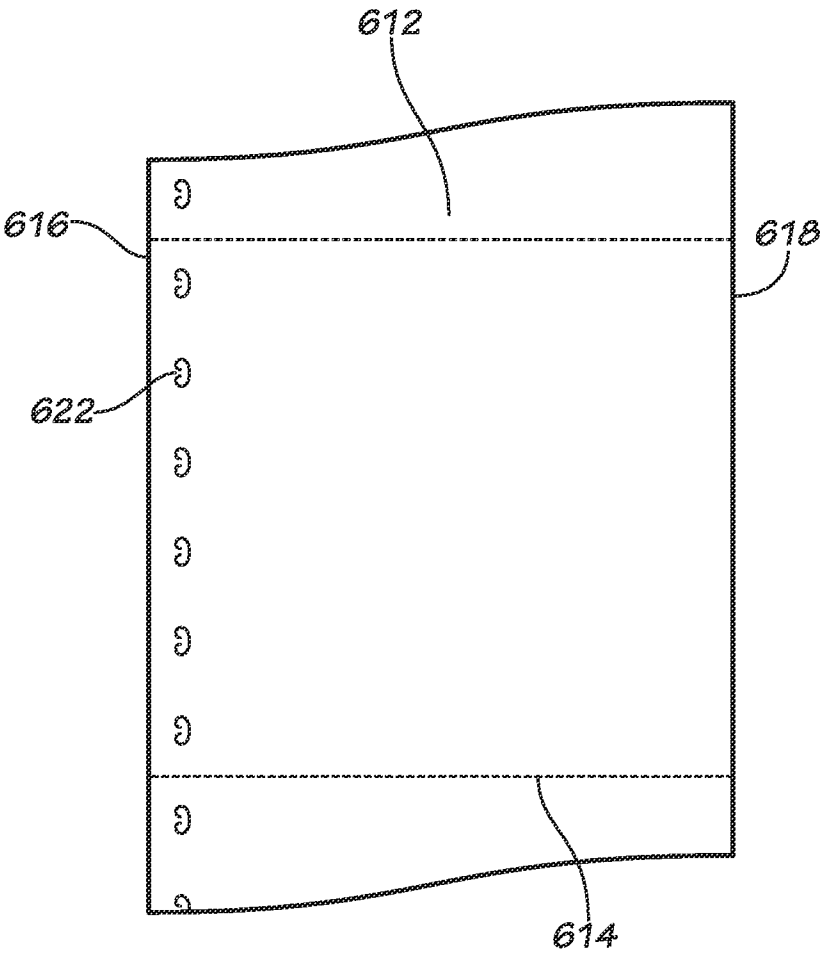

In one aspect illustrated in FIGS. 6A-6B, the cold seal adhesive 626 is applied on the inner surface 610 of the flexible film such that it extends substantially along the first lateral edge portion 612 and second lateral edge portion 614 that form the first end seal and second end seal, respectively. The cold seal adhesive 626 also extends along portions of the first longitudinal edge portion 616 and second longitudinal edge portion 618 that form the longitudinal fin seal. For example, the cold seal adhesive 626 may be applied to a portion of the inner surface 610 of the flexible film that is laterally interior 617 to the opposing edge portion 616 in which the tamper-indicating element 622 is formed.

Figure 7B:
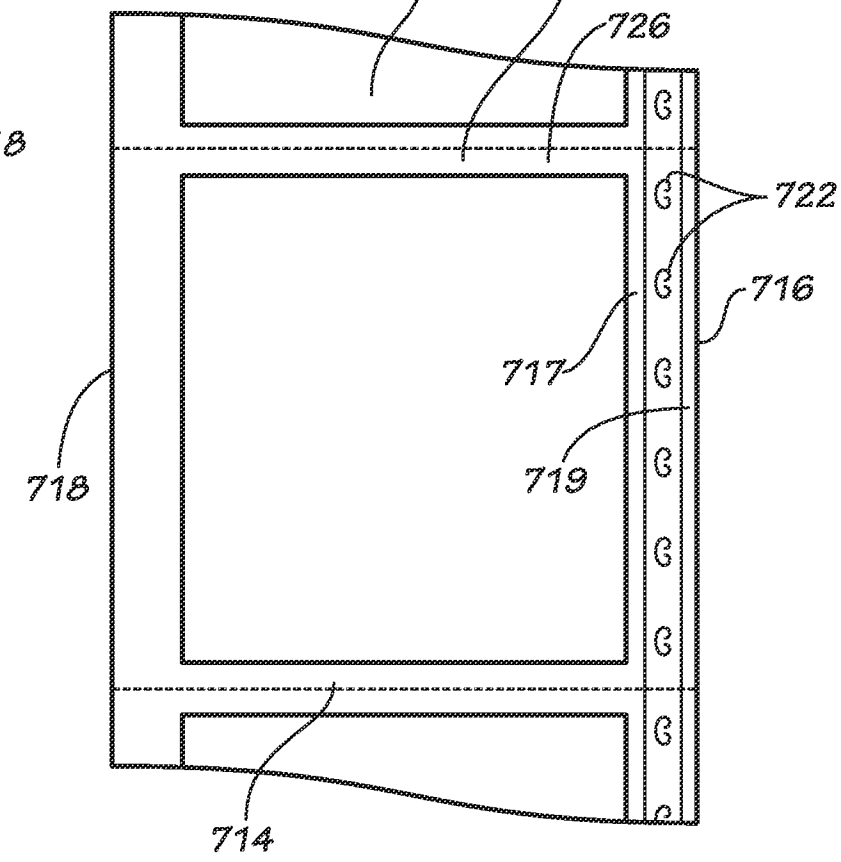
Figure 7A:
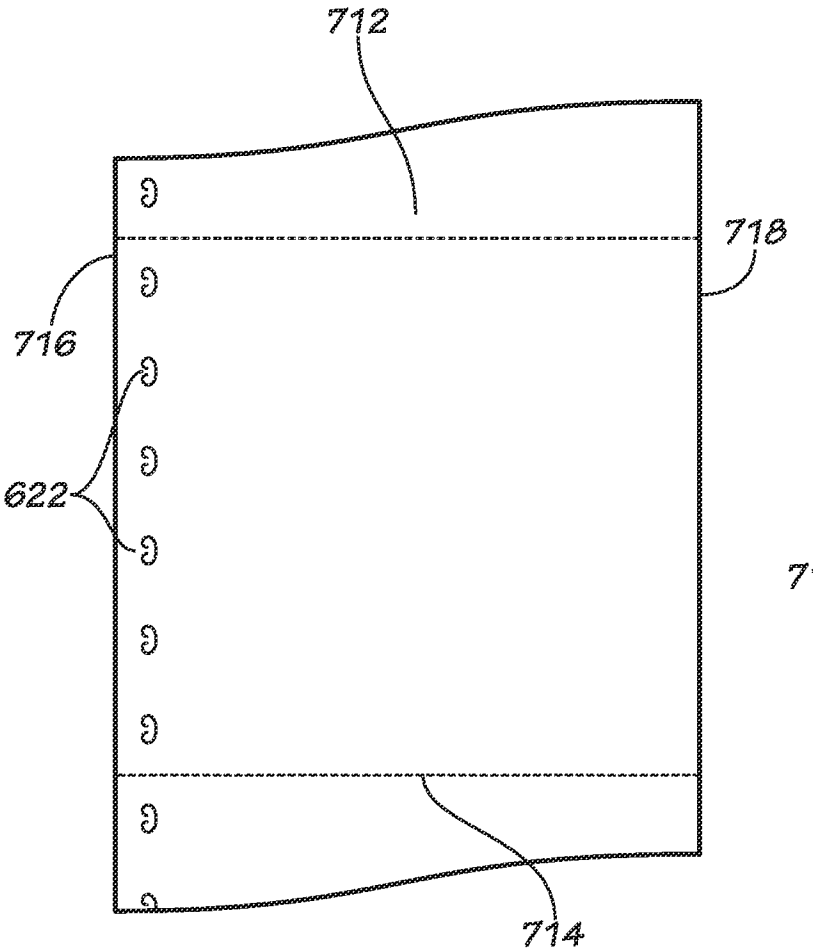

In another aspect illustrated in FIGS. 7A-7B, the cold seal pattern 726 is applied to a portion of the inner surface 710 of the flexible film such that it extends substantially along the first lateral edge portion 712 and second lateral edge potion 714 that form the first end seal and second end seal, respectively. The cold seal adhesive 726 also extends along portions of the first longitudinal edge portion 716 and second longitudinal edge portion 718 that form the longitudinal fin seal. For example, the cold seal adhesive 726 may be applied to a portion of the inner surface 710 of the flexible film that is both laterally interior to 717 and laterally exterior to 719 and extending longitudinally along the opposing edge portion 718 in which the tamper-indicating element 722 is formed.

By changing the geometry of the pattern of cold seal adhesive, the premature removal of the one or more chads formed by the self-terminating shapes can be reduced or eliminated. Specifically, the modified pattern of cold seal adhesive eliminates incidental contact that occurs between the outer surface of the flexible film of the self-terminating shape with the cold seal adhesive in embodiments in which the flexible film is wound into roll form. Alternatively, the premature removal of the one or more chads may be avoided by modifying the chemistry of the cold seal adhesive or by using of one or more outer coatings on the outer surface of the flexible film that could impart the same functionality by reducing the cling force of the cold seal adhesive to the outer surface of the flexible film at the self-terminating shape.

Although the above-described embodiments describe the self-terminating shapes as being disposed in the longitudinal fin seal, the self-terminating shapes also may be positioned in either or both of the transverse end seals. For example, in embodiments a recloseable flexible package may have a plurality of self-terminating shapes disposed in any combination of the transverse end seals and longitudinal fin seal.

The recloseable flexible packages may be prepared from a laminate comprising a continuous web of flexible film having a width with a pair of opposing longitudinal edge portions. A series of self-terminating shapes are positioned in an area extending along one or both of the opposing longitudinal edge portions of the flexible film. The laminate includes an adhesive layer along at least the pair of opposing longitudinal edge portions; however, the area in which the self-terminating shapes are positioned is substantially free of the adhesive layer. Accordingly, in embodiments the adhesive layer is positioned laterally interior and/or exterior to the area in which the series of self-terminating shapes are formed.

The recloseable flexible packages may be prepared using either rolls of the aforementioned laminate or may be prepared by forming the self-terminating shapes in the continuous web and applying the adhesive layer to the continuous web directly in-line with the packaging assembly. The packaging assembly may include one or more products (i.e., a confectionary product such as a chocolate bar) which are encased in a generally tubular package formed from a length of a laminate in the form of a wrapper. The package is produced, for example, using a flow-wrap packaging machine in which the laminate is fed from a roll, folded about each product in turn, and sealed to fully enclose the product. As each package is sealed, the laminate is cut to separate the closed package from the remainder of the film. During the process of forming the package, the opposing longitudinal edge portions are brought into contact and bonded together, inner surface to inner surface, to form a longitudinal fin seal extending longitudinally along the package. Opposing edge portions of the laminate that extend beyond the transverse ends of the product are also brought together and bonded together to form first and second end seals at either end of the product.

In embodiments in which the laminate for forming the package is formed in-line with the packaging assembly, the package may be prepared by first forming the laminate in-line from a continuous web of the flexible film having a width defined by two opposing longitudinal edges, and by forming a series of self-terminating shapes in the flexible film along one or both of the opposing edges using a mechanical punch, laser, or other suitable means. The adhesive then may be applied to the flexible film along at least a portion of the two opposing edges of the flexible film while keeping the area in which the self-terminating shapes are positioned substantially free from the adhesive. The laminate then may be introduced directly into the flow-wrap packaging machine to form the package as described above.

The self-terminating shapes used for tamper evidence provided in packaging materials, especially those that are recloseable, provide a simple and visual indication that the package has been opened and possibly adulterated. Existing methods of tamper evidence generally employed in consumer packaging generally require use of secondary materials added to the packaging material that are destroyed or damaged in a readily apparent manner when the primary package is opened. Use of these existing methods, therefore, requires an additional application step after packaging the product, and may be defeated prior to customer end use.

The self-terminating shapes used for tamper evidence provided herein, however, are incorporated into the primary packaging material, and therefore, do not require an additional application step after packaging the product. The self-terminating shapes also are simple and are more difficult to defeat. For example, relatively simple printed patterns applied to the outer surface of the flexible film in which the self-terminating shapes are formed can render it nearly impossible to realign the seal in a manner that is undetectable. In addition, in embodiments with an openable access panel, the portion of the self-terminating shape that remains attached to the flexible reclose feature (i.e., the tab-like area between the two chads) will not re-adhere to the flexible film due to the kill zone in that area.

While the present invention has been described in detail with respect to specific embodiments thereof, it will be appreciated that those skilled in the art, upon attaining an understanding of the foregoing may readily conceive of alterations to, variations of, and equivalents to those embodiments.

The invention claimed is:

1. An opening system for a recloseable package comprising:

a flexible film having an openable panel section for providing an access opening through the flexible film, the openable panel section being defined by a line of weakness forming a defined opening in the flexible film;

a flexible reclose feature disposed on and covering the defined opening of the openable panel section, the flexible reclose feature including a resealable adhesive layer extending beyond the defined opening for releasably adhering the flexible reclose feature to the flexible film about the defined opening; and a tamper indicating element comprising one or more self-terminating shapes formed in the flexible reclose feature or the flexible film, such that the one or more self-terminating shapes are surrounded by the flexible reclose feature or the flexible film in which the one or more self-terminating shapes are formed, such that initial opening of the openable panel section results in one or more chads being formed from the one or more self-terminating shapes, the one or more chads of the tamper indicating element being transferred from the flexible reclose feature to the flexible film or from the flexible film to the flexible reclose feature, wherein the one or more self-terminating shapes are characterized by an open geometry.

2. The opening system of claim 1, wherein the open geometry comprises a symmetrical, open curvilinear shape.

3. The opening system of claim 2, wherein the symmetrical, open curvilinear shape is an open bean shape having at least one tear initiation point that comprises a J-hook.

4. The opening system of claim 1, wherein each of the one or more self-terminating shapes forms two chads upon opening of the openable panel section.

5. The opening system of claim 1, wherein the one or more self-terminating shapes are formed in both the flexible film and the flexible reclose feature.

6. The opening system of claim 1, wherein the resealable adhesive layer comprises a pressure sensitive adhesive.

7. The opening system of claim 6, wherein the portion of the first film and/or flexible reclose feature in which the tamper indicating element is formed is substantially free of the pressure sensitive adhesive.

8. A recloseable package for containing a product therein comprising the opening system of claim 1.

9. A tamper-indicating element comprising one or more self-terminating shapes formed in a flexible reclose feature or a flexible film, such that the one or more self-terminating shapes are surrounded by the flexible reclose feature or the flexible film in which the one or more self-terminating shapes are formed, the one or more self-terminating shapes comprising an open curvilinear shape, wherein the open curvilinear shape comprises a symmetrical open bean shape having at least one tear initiation point that comprises a J-hook.

10. A flexible reclose feature for use in recloseable packages comprising a tamper-indicating element comprising one or more self-terminating shapes formed in the flexible reclose feature, such that the one or more self-terminating shapes are surrounded by the flexible reclose feature in which the one or more self-terminating shapes are formed, such that initial opening of the flexible reclose feature by separating the flexible reclose feature from a substrate results in one or more chads being formed from the one or more self-terminating shapes, the one or more chads of the tamper-indicating element being transferred from the flexible reclose feature to the substrate, wherein the one or more self-terminating shapes are characterized by an open geometry.

11. The opening system of claim 3, wherein the open bean shape comprises two tear initiation points that each comprises a J-hook.

12. The tamper-indicating element of claim 9, wherein the open bean shape comprises two tear initiation points that each comprises a J-hook.

13. The flexible reclose feature of claim 10, wherein the open geometry comprises a symmetrical, open curvilinear shape.

14. The flexible reclose feature of claim 13, wherein the symmetrical, open curvilinear shape is an open bean shape having at least one tear initiation point that comprises a J-hook.

15. The flexible reclose feature of claim 14, wherein the open bean shape comprises two tear initiation points that each comprises a J-hook.

16. The flexible reclose feature of claim 10, wherein each of the one or more self-terminating shapes forms two chads upon separating the flexible reclose feature from the substrate.

17. The flexible reclose feature of claim 10, wherein the flexible reclose feature includes a resealable adhesive layer releasably adhering the flexible reclose feature to the substrate.

18. The flexible reclose feature of claim 17, wherein the resealable adhesive layer comprises a pressure sensitive adhesive.

19. The flexible reclose feature of claim 18, wherein the portion of the flexible reclose feature in which the tamper-indicating element is formed is substantially free of the pressure sensitive adhesive.

20. A recloseable package for containing a product therein comprising the flexible reclose feature of claim 10.

* * * * *